United States Patent [19]

Dietrich

[11] Patent Number: 4,527,855

[45] Date of Patent: Jul. 9, 1985

[54] ELECTRICAL PLUG CONNECTION FOR AN ELECTRICAL CABLE CONTAINING A TRACTION RELIEF

[75] Inventor: Bernhard Dietrich, Eichenau, Fed. Rep. of Germany

[73] Assignee: SDS-Elektro GmbH, Deisenhofen, Fed. Rep. of Germany

[21] Appl. No.: 419,834

[22] Filed: Sep. 20, 1982

[30] Foreign Application Priority Data

Sep. 18, 1981 [DE] Fed. Rep. of Germany ..... 3137262

[51] Int. Cl.[3] ..... H01R 13/58

[52] U.S. Cl. ..... 339/104

[58] Field of Search ..... 339/104, 117 R, 21 BM

[56] References Cited

U.S. PATENT DOCUMENTS

| | | | |
|---|---|---|---|
| 1,964,350 | 6/1934 | Greene | 339/104 |
| 2,366,910 | 1/1945 | Kollath | 339/104 X |
| 3,951,506 | 4/1976 | Bennett et al. | 339/104 |
| 4,346,954 | 8/1982 | Appling | 339/117 R |
| 4,477,136 | 10/1984 | Smith | 339/21 BM |

FOREIGN PATENT DOCUMENTS

| | | | |
|---|---|---|---|
| 899320 | 5/1945 | France | 339/104 |

*Primary Examiner*—Eugene F. Desmond

*Attorney, Agent, or Firm*—Murray Schaffer

[57] ABSTRACT

An electrical plug connection having a connection casing and a tubular adapter screwed on to the latter which encloses a space for the wires of the cable which includes a traction relief cable. The traction relief cable is tensionally connected to a traction relief anchor which is braced within the adapter by a ring-shaped support shoulder which reduces the interior diameter of the adapter.

8 Claims, 4 Drawing Figures

ELECTRICAL PLUG CONNECTION FOR AN ELECTRICAL CABLE CONTAINING A TRACTION RELIEF

BACKGROUND OF THE INVENTION

The present invention relates to an electrical plug connection having a plug casing and a tubular, threaded adapter enclosing the interior space in which the cable wires are connected and containing at its center a traction relief cable, capable of absorbing high mechanical stresses, tensionally connected to the adapter.

A plug connection of this type is known from DE-GM No. 80 07 106. The tension connection between the traction relief cable and the adapter consists, in this instance, of a ring eyelet which is pinched into or soldered to the traction relief cable and supported upon a pin pushed between two diametrically opposed bore holes in the adapter. With this type of traction relief, the pin can only be used when the adapter is already screwed on to the plug casing. As a result of the cramped space within the connection area, particularly in the case of multi-wire cables, this use of a pin, which assumes a perfect alignment of the ring eyelets with the cross-drilled bore holes, proves to be difficult.

The object of the present invention is to create a plug connection of the type mentioned above, in which the tensionally joined connection of the traction relief cable to the adapter component of the cable is so designed as to simplify its assembly.

SUMMARY OF THE INVENTION

The foregoing task is resolved in the present invention in that the adapter is provided with a ring-shaped support shoulder at the cable end, which shoulder reduces the interior diameter of the adapter. A traction relief anchor element is supported against the shoulder and is tensionally connected to the traction relief cable of the electrical cable.

It is possible by this means to connect the traction relief anchor with the easily accessible end of the traction relief cable by way of the adapter which is thrust back over the electrical cable so that a secure force-locking connection can be achieved by screwing the adapter to the plug casing. In this manner the occurrence of strain between the plug casing and the cable causes all of the construction components involved to be pressed together and no traction forces are at work upon the electrical wires and their soldered joints with the contact pins.

Advantageous variants and further refinements of the plug connection associated with the invention are set forth in the accompanying disclosure.

The plug connection under application is shown in a simplified schematic representation in the drawing with a number of designs chosen for the sake of example.

DESCRIPTION OF THE INVENTION

Figure 1:
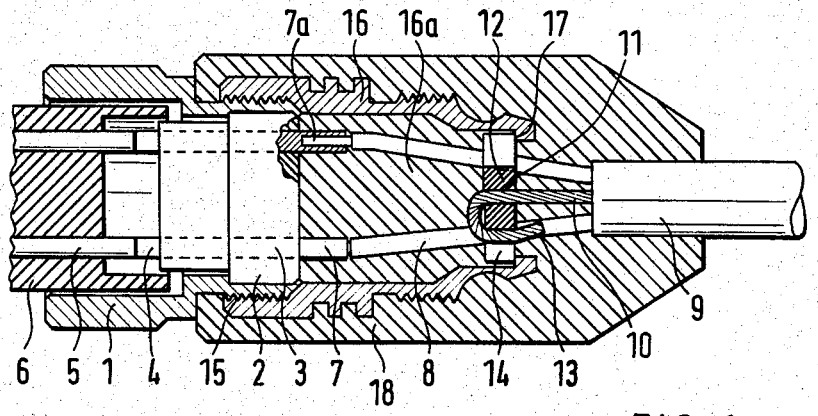
FIG. 1 is a longitudinal cross-section view of one form of the present invention.

The assembled plug connection shown in FIG. 1 comprises a socket casing 1 which contains a contact carrier 2 of insulating material within which fixed contact pins 3 are embedded. The front ends 4 of the pins 3 are in electrical contact with the insertable contacts 5 of a matching plug 6. The rear ends 7 of the contact pins 3 are provided with bore holes **7*a*, into which the wires 8 of the cable 9 are soldered. The cable 9 containing a traction relief cable 10**.

Figure 2:
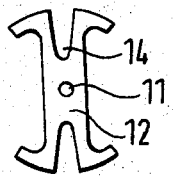
FIG. 2 is a plan view of the traction relief anchor used in the embodiment shown in FIG. 1.

The traction relief cable 10 is led through a central bore hole 11 of a traction relief anchor element 12 (cf. FIG. 2) after all the wires 8 have been soldered into place. The end 13 of the cable 10 is then bent 180° and pinched within one of the wedged-shaped grooves 14 of traction relief anchor 12. The anchor 12 is braced by its edges on the interior shoulder of a tubular adapter 16 which is screwed on to the plug connection casing 1 by mating screw threads 15. A plastic injection molded body 18, fills the connection space **16*a* defined within the adapter 16, thereby fixing the traction relief anchor 12 in place, surrounding a portion of the plug connection casing 1, the adapter 16 and the terminal section of the cable 9**.

Figure 3:
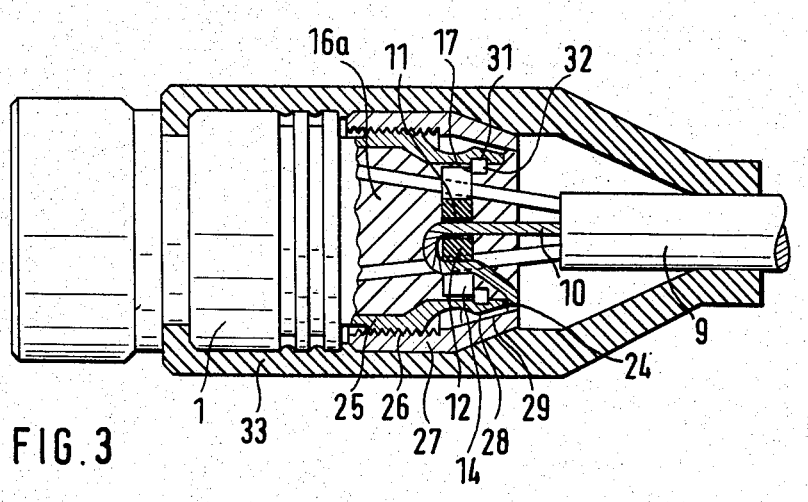
FIG. 3 is a view similar to FIG. 1 showing a second embodiment of the present invention.

In FIG. 3 an assembled plug connection is shown in which the support shoulder supporting the traction relief anchor 12 (cf. FIG. 2), consists of the frontal surface of a snap ring 32 which is seated in a groove 31 of a tubular adapter 25. The end of the traction relief cable 10, in addition to its being pinched in and about the traction relief anchor 12, continues in a meander pattern, to be bent by 180° at least twice around the edge 24 of the adapter 25 and is fastened between a conical surface 28 on the exterior of the adapter 25 and the inner surface 29 of a cone 27 complementary to it. The cone 27 is in turn screwed to the adapter 25 by means of mating screw threads 26.

The advantage of the design shown in FIG. 3 consists in the fact that the snap ring 32 does not necessarily have to be screwed to the socket connection casing 1 together with the adapter 25, but instead can be put in place afterwards, thereby creating more free space for the backward and forward movement of the adapter 25 upon the cable 9 necessary for assembly.

In the example shown in FIG. 3, the interior area **16*a* is simply fully injected with plastic while the exterior housing or cover 33** of the plug connection consists of a thermal-shrunk shaped part.

Figure 4:
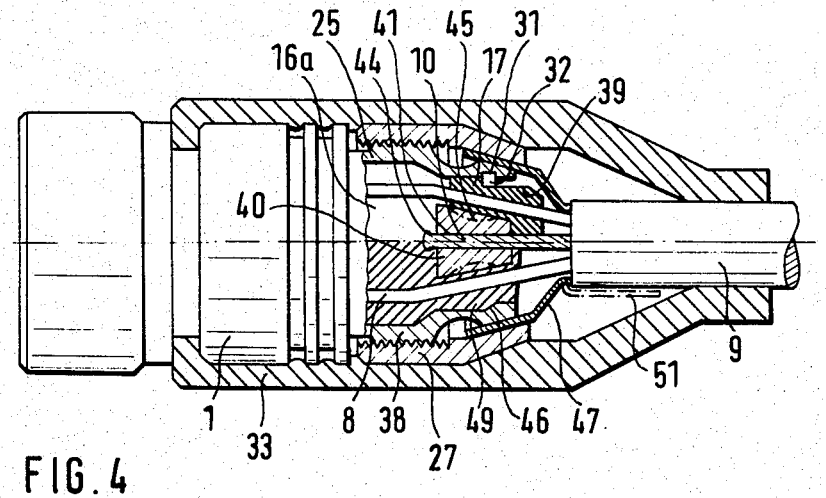
FIG. 4 is a similar view showing a third and a fourth embodiment on either side of longitudinal axis.

FIG. 4 shows two designs of a plug connection in each of which the traction relief element is constructed in two parts.

Corresponding to the upper half of FIG. 4, the support shoulder 17 is again formed by the snap ring 32 which is set, resiliently mounted, in the groove 31 of the adapter 25. A nipple 40 is held within a plastic shaped element 39, supported upon the support shoulder 17. The traction relief cable 10 is passed through the central bore hole 41 of the nipple 40, and soldered or pinched to the nipple 40 at 44 or 45 respectively.

In the lower half of FIG. 4 the support shoulder is formed by a conical surface 46 formed on the adapter 38 and the traction relief obtained by fully injecting the remaining interior area **16*a* with a plastic material mass 49 after carrying out the successive assembly steps. The plastic mass 49, after hardening, then acts in conjunction with and in association with the nipple 40 as the traction relief anchor. A high frequency shield 47** is also provided.

In the first assembly steps, the insulation from cable 9 is removed and the wires 8, the traction relief cable 10, as well as a high frequency shield 47, are cut to the required length. In the second assembly step the high frequency shield 47 is turned inside out over the cable 9 (cf. 51) and slid over the adapter 38. In the third assembly step, the nipple 40 is placed upon the end of the traction relief cable and soldered at 44 or pinched at 45. In the fourth assembly step, the wires 8 are soldered into the contact pins 7 and the adapter 38 slid over the cable 9, the inverted high frequency shielding 51 and over the wires 8 and screwed to the plug connection casing 1. In the fifth assembly step, the interior area 16*a* is fully injected with plastic material. In the sixth assembly step, the high frequency shielding 47 is pinched between the adapter 38 and the cone piece 27 by screwing the latter on to the former in the same way as was the end of the traction relief cable in the design shown in FIG. 3. In the seventh and final assembly step, the thermally shrinking shaped outer housing or cover 54 is applied.

I claim:

1. An electrical plug for connection to an end of a cable having a central traction member, comprising a housing and a threaded tubular adapter, said adapter having an annular supporting shoulder at the cable end reducing its interior diameter, and a traction relief element inserted within the adapter to be supported against said shoulder, said traction relief element comprising a plate having a central bore hole for the admission of, and having wedge shaped recesses for the clamping of, the traction relief cable, said cable being bent at 180 degrees through said bore hole and recesses so as to be held in said adapter against stress.

2. The electrical plug in accordance with claim 1, wherein the annular shoulder consists of the frontal area of a snap ring, said snap ring being seated in an interior groove formed in the wall of the adapter.

3. The electrical plug in accordance with claim 1, wherein said annular shoulder comprises an annular surface conical in longitudinal cross-section.

4. The electrical plug in accordance with claim 1 wherein the adapter has a conical exterior surface and includes an outer cover having a corresponding conical interior surface, the free end of the traction relief cable being clamped between said conical surfaces.

5. The electrical plug in accordance with claim 1, including a plastic mass embedding said plastic relief element, said plastic mass being hardened and located within the interior of said adapter abutting the support shoulder.

6. An electrical plug for connection to an end of a cable having a central traction member, comprising a housing and a threaded tubular adapter having an annular surface tapered in cross section, a nipple secured to the end of the traction relief cable and having a conical exterior surface defining with said adapter a space surrounding said nipple, and a plastic member inserted in said space and the remainder of said adapter securely embedding said nipple and filling said adapter.

7. The electrical plug according to claim 6, including a snap ring seated in an interior groove formed in the wall of said adapter, the frontal area of said snap ring forming a shoulder for supporting said plastic mass.

8. The electrical plug according to claim 6, wherein the plastic member comprises a mass insertable into said adapter as an uncured flowing material and is hardened in situ, about said nipple.

* * * * *